United States Patent [19]

Dokan

[11] Patent Number: 4,601,149

[45] Date of Patent: Jul. 22, 1986

[54] STRIP TO PROTECT AND SEAL BATH TUB CORNERS

[76] Inventor: Pierre E. Dokan, 11240 Chandler Blvd., N. Hollywood, Calif. 91601

[21] Appl. No.: 747,786

[22] Filed: Jun. 24, 1985

[51] Int. Cl.[4] ..... E04D 1/36

[52] U.S. Cl. ..... 52/287; 52/35; 52/716

[58] Field of Search ..... 52/35, 287, 288, 716

[56] References Cited

U.S. PATENT DOCUMENTS

| | | | |
|---|---|---|---|
| 2,090,588 | 8/1937 | Witsell | 52/35 |
| 2,178,501 | 10/1939 | Stancampiano et al. | 52/285 |
| 2,274,317 | 2/1942 | Bonnell | 52/287 |
| 2,303,864 | 12/1942 | Reasor | 52/717 |
| 2,541,768 | 2/1951 | Keller | 52/287 |
| 3,216,164 | 11/1965 | Stillman | 52/287 |
| 3,222,837 | 12/1965 | Daley | 52/288 |
| 3,271,232 | 9/1966 | Moore | 428/130 |
| 3,604,169 | 9/1971 | Smith | 52/288 X |
| 3,667,177 | 6/1972 | Biela | 52/287 X |
| 3,996,705 | 12/1976 | Gutierrez | 52/35 |
| 4,067,155 | 1/1978 | Ruff et al. | 52/288 X |
| 4,091,586 | 5/1978 | Schwartz . | |
| 4,157,271 | 6/1979 | Moore | 52/288 X |

FOREIGN PATENT DOCUMENTS

| | | | |
|---|---|---|---|
| 641869 | 4/1964 | Belgium | 52/287 |
| 587911 | 11/1933 | Fed. Rep. of Germany | 52/287 |
| 2361285 | 6/1975 | Fed. Rep. of Germany | 55/288 |
| 983809 | 2/1965 | United Kingdom | 52/288 |

*Primary Examiner*—William F. Pate, III

*Attorney, Agent, or Firm*—William W. Haefliger

[57] ABSTRACT

The invention concerns, for combination with a corner defined by an upright wall, and a generally horizontal surface as defined by a bath tub or the like, and cured mastic applied to said corner, the following:

(a) a longitudinally elongated, plastic strip, which is generally crescent shaped in cross section, the strip having terminal edges defined by laterally spaced lips adapted to be supported adjacent the wall and the surface so that the strip confines the mastic in the corner in strip installed position, (b) the mastic in cured state being incompletely rigid, (c) and barb structure integral with the strip and projecting therefrom into the mastic, which in cured state anchors the barb means to retain the strip in said installed position.

13 Claims, 4 Drawing Figures

STRIP TO PROTECT AND SEAL BATH TUB CORNERS

BACKGROUND OF THE INVENTION

This invention relates generally to the sealing of joints at corners between walls, which may be tiled, and surfaces such as bath tubs surfaces constantly exposed to water and moisture. More specifically, it concerns improvements in sealing devices, for this purpose.

There is a constant need and occasion for installation and repair of bath tubs, requiring the sealing off of corners as referred to. Unless such seals are effective, water will very soon leak and cause damage.

In the past, sealant was applied to and along the joint at the inside, exposed corner; however, such sealant was exposed to wear and weathering, and tended to crack and deteriorate, allowing leakage. Mouldings have been applied to the sealant at the corner, as in U.S. Pat. No. 2,090,588 to Witsell; however, such mouldings did not solve the problem of leakage, since they could separate from contact with the wall and tub surfaces, and from contact with the sealant, due to settling of the bathtub and wear. As a result, water could leak through separation cracks and attack the sealant.

SUMMARY OF THE INVENTION

It is a major object of the invention to provide a particular moulding strip, installable in such a way as to overcome the above as well as other problems in this art. Basically, the strip is installable in combination with mastic or sealant, which is cohesive yet not rigid when cured, at the corner between the bathtub surface and wall. The strip comprises:

(a) a longitudinally elongated, extruded, plastic strip, which is generally crescent shaped in cross section, the strip having spaced, terminal edges defined by lips adapted respectively to engage said wall and said surface so that the strip confines the mastic in said corner in strip installed position, (b) the mastic in cured state being non-rigid, (c) and barb means integral with the strip and projecting therefrom into the mastic, which in said cured state anchors the barb means to retain the strip in said installed position.

As will be seen, the strip typically includes at least one integral, longtudinally extending projection on which said barb means is formed, the projection everywhere spaced from said lips; and the barb means defines a barbed tip or tips spaced from the strip, the tip or tips being longitudinally elongated.

Further, the barbed projection may extend toward the corner, and may extend beneath the wall at the corner. In a modified form, the strip includes two or three integral, longitudinally extending, spaced apart projections on each of which said barb means is formed, the projections everywhere spaced from the lips. The latter may be attached to the wall or bathtub surface via pressure adhesive tape.

The mastic or sealant preferably consists of silicone putty, which is resilient when cured, and into which the barb means fully penetrate. Thus, the construction is such that the cured, resilient mastic tensions the barb or barbs urging the strip toward the corner, with the lips resiliently and pressurally engaging the wall and surface. Accordingly, even though the tub may settle and slightly change the corner configuration, the resilient mastic, and the warpable strip anchored to it, conform to the change, and maintain the pressure seal, established for example due to mastic shrinkage toward the corner.

Finally, the strip is configured in cross section to allow strip deflection toward the mastic.

These and other objects and advantages of the invention, as well as the details of an illustrative embodiment, will be more fully understood from the following specification and drawings in which:

DRAWING DESCRIPTION

DETAILED DESCRIPTION

Figure 1:
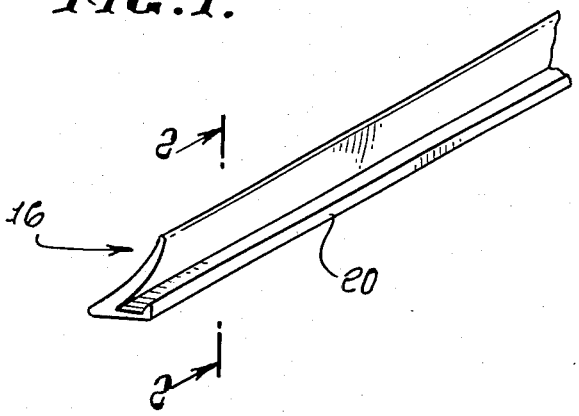
FIG. 1 is a perspective view showing a strip construction in accordance with the invention; but prior to installation.
Figure 2:
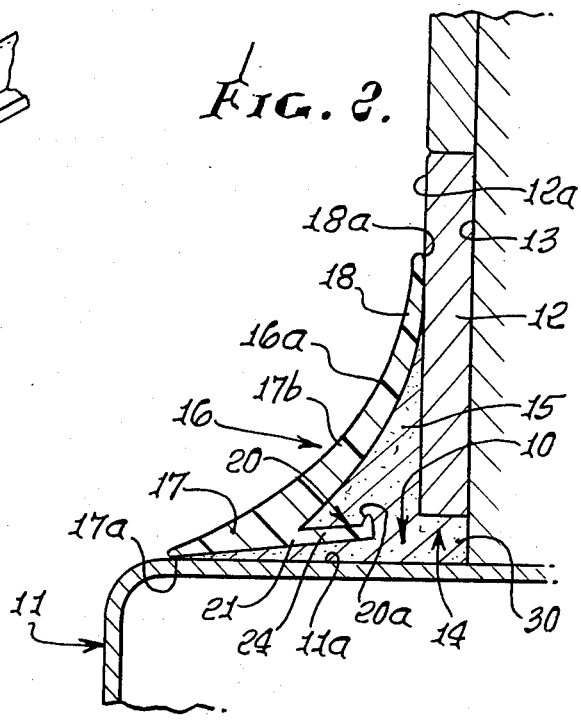
FIG. 2 is an enlarged section taken on lines 2—2 of FIG. 1, and showing the strip installed.

Referring first to FIGS. 1 and 2, a corner 10 is defined by upper horizontal surface 11*a* of a bath tub 11 or the like (shower, wash basin, etc.), and an upright wall 12*a*. The latter may be defined as by tile pieces 12 attached to wall board 13. One purpose of the invention is to effectively seal off the joint 14 between 11*a* and 12*a*, and which may contain an old grout 30. To that end, mastic 15 is first applied to the corner in an amount as generally indicated, and along the corner horizontal length, parallel to a longitudinally elongated, extruded plastic strip 16.

As seen in FIG. 2, the strip 16 is generally crescent shaped in cross section. It is warpable, and twistable, and typically consists of extruded plastic material such as PVC. It has an outwardly concave medial surface 16*a* merging with two spaced apart lip sections 17 and 18 terminating at inner edges 17*a* and 18*a* adapted to sealingly engage, with pressure, the surface 11*a* and wall 12*a*, to confine the mastic in the corner and isolate it insofar as possible from exposure to external moisture, collecting on the bath tub surface 11*a* or draining on wall surface 12*b* outside the corner. Lip sections 17*a* and 18*a* are of reduced thickness to flex allowing mid section 17*b* to move toward the corner; while mid-section 17*b* is thicknened.

In accordance with an important aspect of the invention, barb means, generally indicated at 20, is provided to be integral with the strip 16, preferably by joining it thereto at 21, closer to lower lip 17 then upper lip 18. The barb means projects generally rightwardly but is spaced from the corner 10. In this configuration, mastic, in cured state, anchors the barb means to retain the strip in installed position with lips engaging the surface 11*a* and wall 12*a*. Note that the barb means resists leftward displacement of the strip 16 due to rightward extension of the barb means, with barb shoulders 20*a* facing generally leftwardly and engaging the mastic to resist leftward movement.

Preferably, the mastic in cured state is not rigid, and slightly resilient, to enhance the anchoring effect. Thus, slight shrinkage of the mastic in a rightward and downward direction, during curing, tends to pull the barb means in that direction, whereby the crescent-shaped strip flexes slightly and lips 17*a* and 18*a* pressurally engage the surface 11*a* and wall 12*a*, to seal off water access to the mastic.

More specifically, the barb tips 20*b* are formed on a projection 24 that extends longitudinally and is integral with and parallel to strip 16.

The mastic preferably consists of silicone putty, one example being Dow Corning Sanitary Silicone Sealant, such sealant being non-rigid and slightly resilient when cured, to provide the anchoring action described. It bonds to surface 11*a* and wall 12*a*, and slight shrinkage occures rightwardly upon curing. Accordingly, a simple, effective, tight, seal is provided, and the strip pressuraly engages the surface 11*a* and wall 12*a* at lip edge locations 17*a* and 18*a*, extending longitudinally lenghtwise of the strip.

Figure 3:
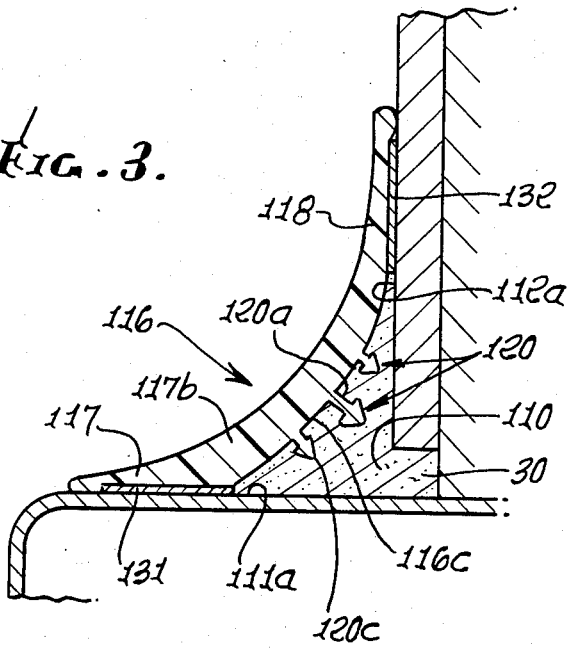
FIGS. 3 and 4 are enlarged sections like that of FIG. 2, but showing modifications.

In FIG. 3, modified strip 116 also has lips 117 and 118 of reduced thickness and corresponding to lips 17 and 18. It defines a thickened section 117*b* medially between lips 117 and 118, and approaching the all 112*a* and surface 111*a*. The flat inner side 116*c* of the strip extends across the mastic, and carries three barbs 120 projecting toward corner 110. The barb tips 120*c* are integral with projections 120*a* that are in turn integral with the strip 116. Note that the barbs 120*c* also extend rightwardly and downwardly. The thinning of the lip sections 117 and 118 enhances rightward flexing of the strip during the anchoring and shrinking of the mastic, to enhance the pressural attachment of the lips 118 to surface 11*a* and wall 12*a*. Pressure sensitive tape is employed at 131 and 132 between the lips and the surface and wall, to directly attach the lips to the latter.

Figure 4:
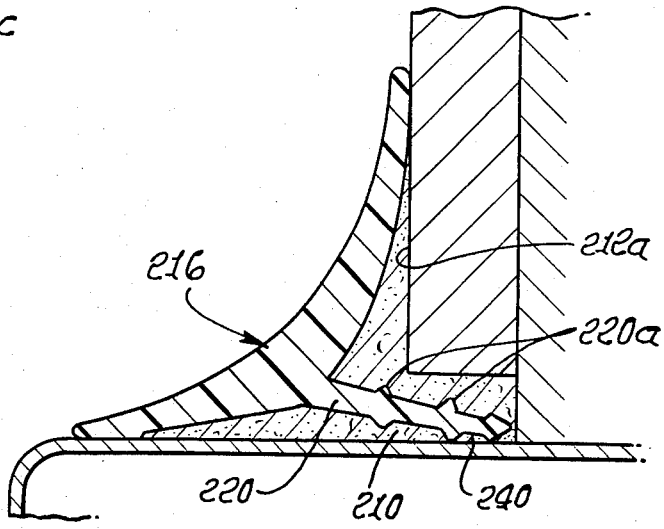

In FIG. 4, the strip 216 carries a single projection 220 that projects into and through the corner 210, and below wall 212*a*, i.e. into the grout at 240. Barbs 220*a* are formed on the projection, as shown. Otherwise, the strip construction is as shown in FIG. 2.

All grout and caulking materials discolor and support mildew, mold, etc. The use of a trim like PVC, or other plastic, impervious to mold and mildew, anchored into long lasting and flexible sealant, such as G.E. or Dow Corning Sanitary Silicone Sealant, assures the seal to be very long lasting and sanitary, without maintenance, except for normal cleaning.

I claim:

1. The combination with a corner defined by an upright wall, and a generally horizontal surface as defined by a bath tub or the like, and cured mastic applied to said corner, (a) a longitudinally elongated, plastic strip, which is generally crescent shaped in cross section, the strip having terminal edges defined by laterally spaced lips supported adjacent said wall and said surface so that the strip confines the mastic in said corner in strip installed position, (b) the mastic in cured state being incompletely rigid, (c) and barb means integral with the strip and projecting therefrom into the mastic, which in said cured state anchors the barb means to retain the strip in said installed position, (d) said strip having geater thickness medially between said lips than at said lips, whereby the lips support said strip for flexing toward the corner, said mastic being resilient in cured state, and tensioning said barb means to urge the strip toward said corner, with said lips resiliently engaging said wall and surface, the mastic engaging the strip proximate both lips.

2. The combination of claim 1 wherein said strip includes at least one integral, longitudinally extending projection on which said barb means is formed, the projection everywhere spaced from said lips.

3. The combination of claim 1 wherein said barb means defines a barbed tip spaced from the strip, the tip being longitudinally elongated.

4. The combination of claim 2 wherein said projection and barb means extend generally toward said corner.

5. The combination of claim 1 wherein said strip includes at least two integral, longitudinally extending, spaced apart projections on each of which said barb means is formed, the projections everywhere spaced from said lips.

6. the combination of claim 1 wherein said mastic consists of silicone putty.

7. The combination of one of claims 2 and 5 wherein said mastic consists of resilient, silicone putty, into which said barb means fully penetrates.

8. The combination of claim 1 said strip lips have substantially flat surfaces presented toward said wall and surface.

9. The combination of claim 1 wherein the strip consists of PVC and is twistable and warpable, and flexed toward the mastic after relative and slight shrinkage of the latter toward the corner.

10. The combination of claim 2 wherein there are three of said projections, which are integral with a thickness portion of the strip.

11. The combination of claim 1 including pressure senstive tape between one lip and said wall, and between the other lip and said surface, and via which the lips are attached to said wall.

12. The combination of claim 2 wherein said projection extends beneath said wall, at said corner.

13. The combination of claim 2 wherein said projection extnds substantially horizontally toward said corner, and is integral with a portion of said strip adjacent the lip that engages said surface.

* * * * *